US007571518B2

(12) United States Patent
Davidson

(10) Patent No.: US 7,571,518 B2
(45) Date of Patent: Aug. 11, 2009

(54) CLAMP FOR CLOSING A FLEXIBLE BAG

(76) Inventor: Brett Davidson, 2/772 Logan Road, Holland Park West, Queensland (AU) 4124

( * ) Notice: Subject to any disclaimer, the term of this patent is extended or adjusted under 35 U.S.C. 154(b) by 338 days.

(21) Appl. No.: 11/569,432

(22) PCT Filed: Jun. 16, 2005

(86) PCT No.: PCT/AU2005/000863

§ 371 (c)(1),
(2), (4) Date: Nov. 21, 2006

(87) PCT Pub. No.: WO2005/123522

PCT Pub. Date: Dec. 29, 2005

(65) Prior Publication Data

US 2007/0220714 A1 Sep. 27, 2007

(30) Foreign Application Priority Data

Jun. 18, 2004 (AU) ..... 2004903296

(51) Int. Cl.
*A44B 21/00* (2006.01)

(52) U.S. Cl. ..... 24/30.5 L; 24/30.5 R; 24/523

(58) Field of Classification Search ..... None
See application file for complete search history.

(56) References Cited

U.S. PATENT DOCUMENTS

| | | | | |
|---|---|---|---|---|
| 4,428,098 | A | 1/1984 | Coker et al. | |
| 4,453,292 | A * | 6/1984 | Bakker | 24/115 G |
| 4,763,388 | A * | 8/1988 | Kemble | 24/30.5 R |
| 5,524,462 | A | 6/1996 | Loughlin | |
| 5,546,637 | A | 8/1996 | Niedecker | |
| 5,611,583 | A | 3/1997 | Bystry et al. | |
| 6,398,273 | B1 | 6/2002 | Aichmann | |

* cited by examiner

*Primary Examiner*—Jack W. Lavinder
(74) *Attorney, Agent, or Firm*—David A. Guerra

(57) ABSTRACT

A clamp (10) including a housing (11) being a first member having a first passage (16) therethrough providing a first jaw and a first opening to said first passage (21) from one side; a shutter (12) being a second member having a second passage therethrough providing a second jaw and a second opening to said second passage (27) from one side; said second member being engaged with said first member far relative sliding movement between an open position in which said first and second jaws are spaced apart and said first and second openings are at least partially aligned and provide access to said first passage from one side and a closed position in which the first and second jaws cooperate to clamp a portion of a bag to be closed there between. The shutter is biased closed by springs (13) and (14) located within the closed passage end of the housing.

20 Claims, 10 Drawing Sheets

CLAMP FOR CLOSING A FLEXIBLE BAG

CROSS-REFERENCE TO RELATED APPLICATIONS

This application is an U.S. national phase application under 35 U.S.C. §371 based upon co-pending International Application No. PCT/AU2005/000863 filed on Jun. 16, 2005. Additionally, this U.S. national phase application claims the benefit of priority of co-pending International Application No. PCT/AU2005/000863 filed on Jun. 16, 2005 and Australia Application No. 2004903296 filed on Jun. 18, 2004. The entire disclosures of the prior applications are incorporated herein by reference. The international application was published on Dec. 29, 2005 under Publication No. WO 2005/123522.

FIELD OF THE INVENTION

This invention relates to a clamp. The invention has particular application to a clamp for closing a flexible bag.

BACKGROUND

Various forms of clamps are known for holding together the sides of flexible bags to thereby close the bag. For example, U.S. Pat. No. 3,629,905 to Cote describes a device which is adapted to clamp the opposed sides of a bag adjacent its mouth together along their length. The device includes two opposed elongate members which form jaws adapted to move towards and away from each other and to clamp the opposite walls of a bag therebetween adjacent the mouth of the bag to thereby close the bag. The device needs to be relatively large so that the elongate members can accommodate the full width of the mouth of the bag and therefore is undesirably large for many applications.

Another example is shown in U.S. Pat. No. 4,428,098 to Coker and Coker which describes a device which is also adapted to clamp together the opposed sides of a bag adjacent its mouth across the full width of the mouth. While the device may seal the bag effectively it also needs to be relatively large.

U.S. Pat. No. 5,546,637 to Niedecker describes a plastic clip which functions differently from the two previously mentioned devices in that it is intended to clamp a sausage casing or bag in which the walls thereof have been gathered to form a tip. However, the Niedecker device has two separate parts which must be fitted to the bag tip and interlocked to close the bag thus making the device undesirably difficult to use. Further, the Niedecker device is not suited for easy reuse, the two parts being undesirably difficult to separate The present invention is aimed at ameliorating one or more of the aforementioned problems and to providing a clamp for efficiently closing a flexible bag and which can be relatively easily reused.

SUMMARY OF THE INVENTION

With the foregoing in view, the invention in one aspect resides broadly in a clamp including:

a first member having a first passage therethrough providing a first jaw and a first opening to said first passage from one side;

a second member having a second passage therethrough providing a second jaw and a second opening to said second passage from one side;

said second member being engaged with said first member for relative sliding movement thereto between an open position in which said first and second jaws are spaced apart and said first and second openings are at least partially aligned and provide access to said first passage from one side and a closed position in which said first and second jaws cooperate to clamp a portion of a bag to be closed therebetween.

Preferably, at least one of said first and second members includes retaining means for retaining a bag portion clamped between said first and second jaws from being removed therefrom through said first and second openings while the first and second members are in the closed position.

Preferably, said clamp includes biasing means for biasing said first and second members to the closed position whereby the clamp would normally hold a bag closed in the in use position and would require force to move the second member to the open position to release the clamp from the bag and open the bag.

Preferably, said second member is a shutter and said first member has a recess which is adapted to slidably receive therein at least a portion of the shutter to provide said relative sliding movement between said first and second members. In such form of the invention it is preferred that said recess be a hollow such that said first member forms a sleeve about the sliding portion of the shutter to locate it securely therein for said relative sliding movement.

Preferably said first and second members are generally rectangular in front view and relatively thin in form. In one such form, said first member has a front face and an opposed rear face, said first passage extends from said front face to said rear face and said first opening extends from a side edge of said first member between said front and rear faces to said first passage. Similarly, in such form, said second member has a front face and an opposed rear face, said second passage extends from said front face to said rear face and said second opening extends from a side edge of said second member to said second passage. In a preferred form, said second passage is a slot in said second member extending between opposed front and rear faces and which opens to one edge of said second member.

Preferably, the clamp includes stop means for stopping relative sliding movement of said first and second members from said closed position to said open position.

In another aspect the invention resides broadly in the combination of first and second members adapted for use in a clamp, the first member having a first passage therethrough and a first opening to said first passage from one side, and securement means for securing the second member thereto for relative sliding movement; and the second member having a second passage therethrough and a second opening to said second passage from one side, said second member being adapted to engage with said guide means of said first member for relative sliding movement between open and closed positions, the parts being so made and arranged that said first and second passages and said first and second openings respectively are at least partially aligned when said first and second members are secured together by said securement means and in the open position and at least said first and second passages are substantially out of alignment when said first and second members are in the closed position. Preferably, when said first and second passages are aligned, said first and second openings are also substantially aligned and when said first and second openings are substantially out of alignment, said first and second openings are also at least substantially out of alignment.

BRIEF DESCRIPTION OF THE DRAWINGS

In order that the invention can be more clearly understood and put into practical effect reference will now be made to the accompanying drawings wherein.

DETAILED DESCRIPTION OF THE DRAWINGS

Figure 2:
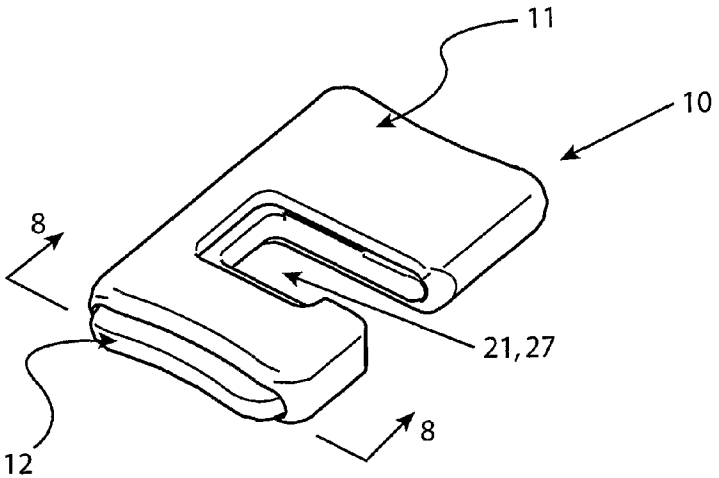
FIG. 2 is a pictorial representation of the clamp of FIG. 1 in the open position.
Figure 1:
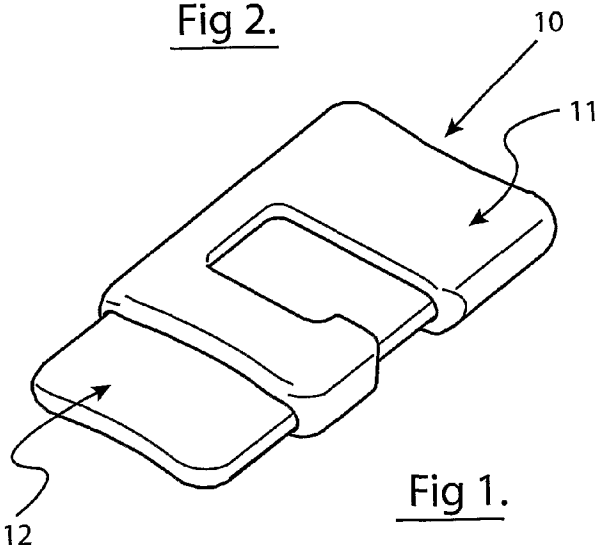
FIG. 1 is a pictorial representation of a clamp according to the invention in the closed position.
Figure 3:
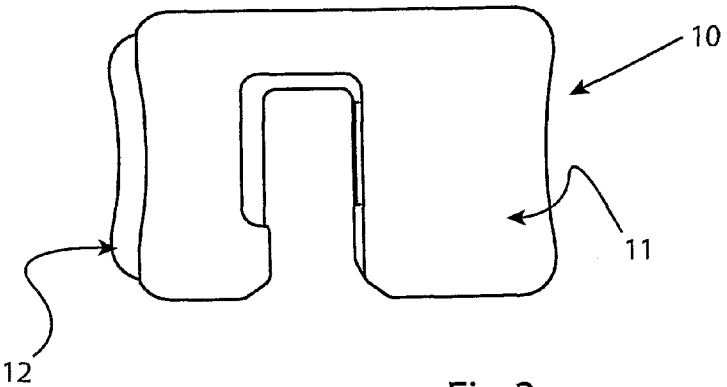
FIG. 3 is a front elevation of the clamp of FIG. 1 in the open position.
Figure 4:
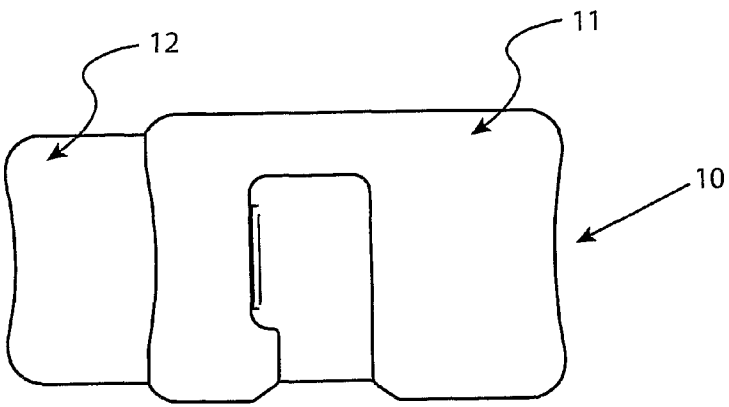
FIG. 4 is a front elevation of the clamp of FIG. 1 in the closed position.
Figure 5:
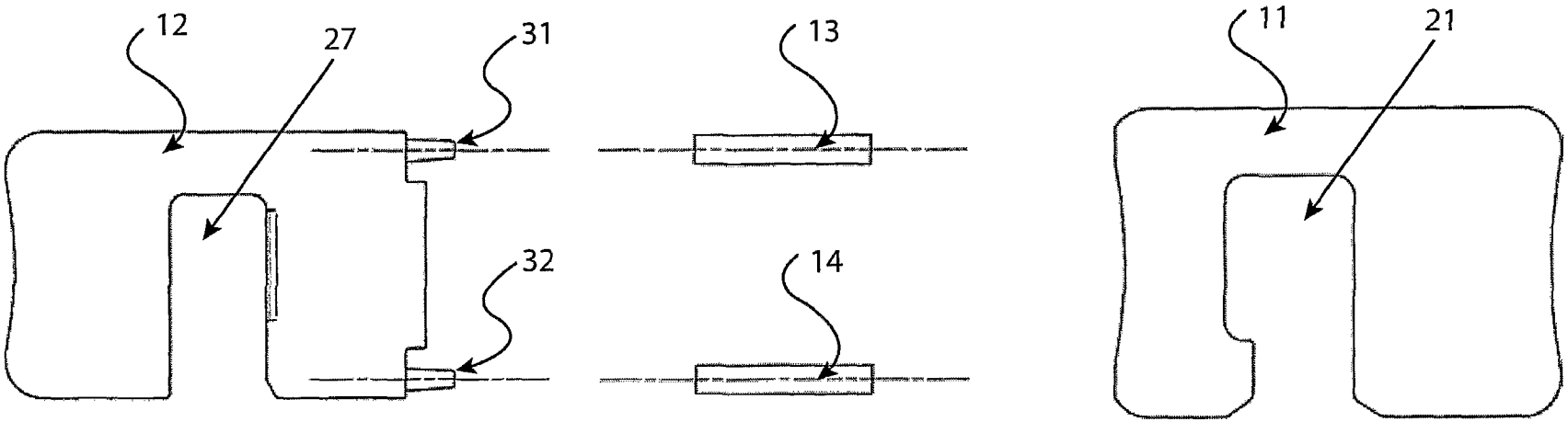
FIG. 5 is a front elevation of the clamp of FIG. 1 with its components in line for assembly.

The clamp 10 illustrated in FIG. 1 includes a housing 11 in which a shutter member 12 is mounted for relative sliding movement thereto and biased to the closed position as shown in FIG. 1 by two spaced apart coil compression springs 13 and 14 which can be seen in FIG. 5.

Figure 6A:
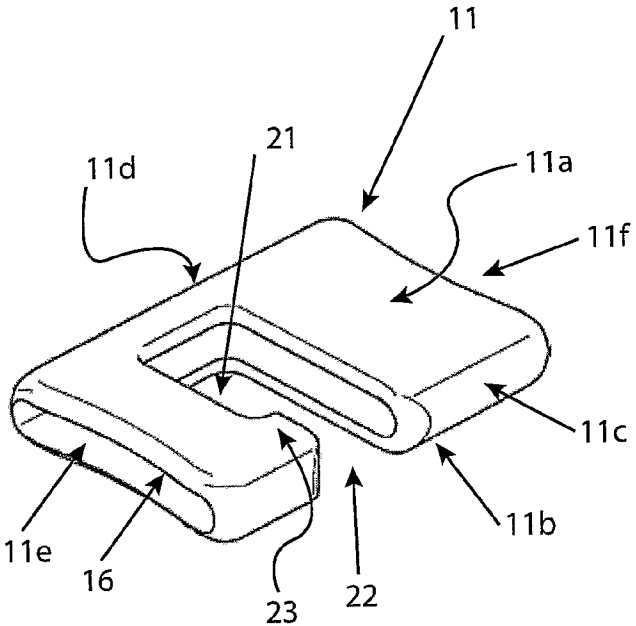
FIG. 6*a* is a pictorial representation of a first component of the clamp of FIG. 1.
Figure 6B:
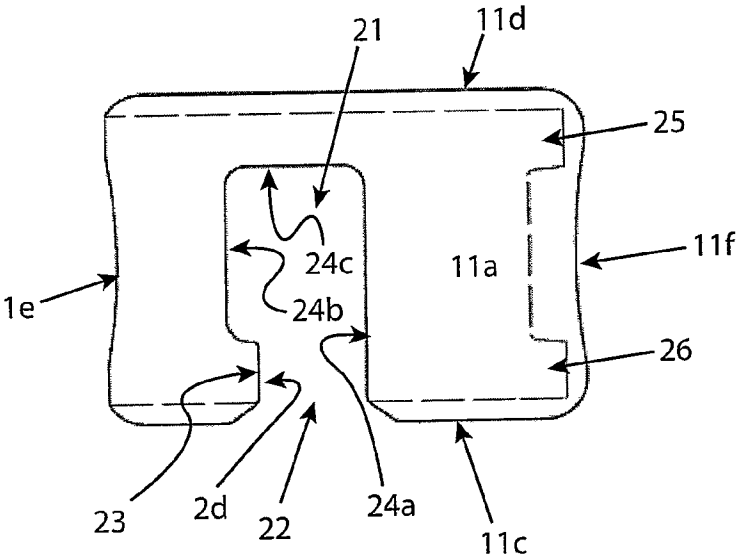
FIG. 6*b* is a front elevation of the first component of FIG. 6*a;*
Figure 6C:
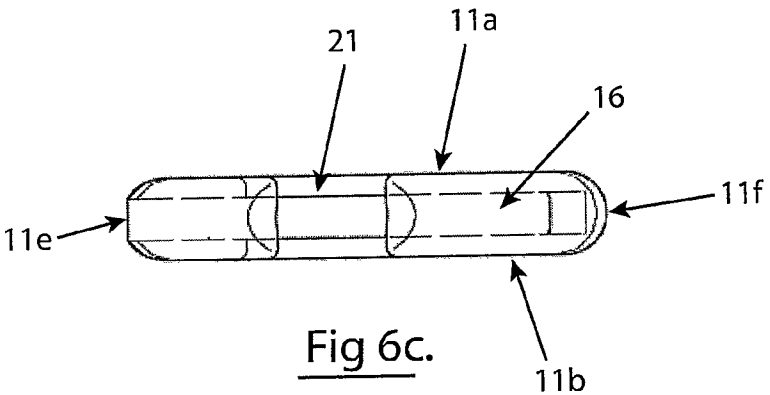
FIG. 6*c* is a side elevation of the first component of FIG. 6*a;*
Figure 7A:
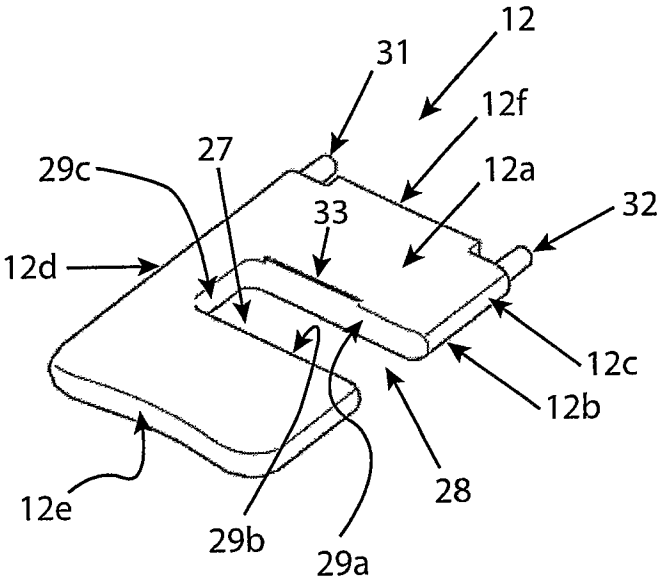
FIG. 7*a* is a pictorial representation of a second component of the clamp of FIG. 1.
Figure 7B:
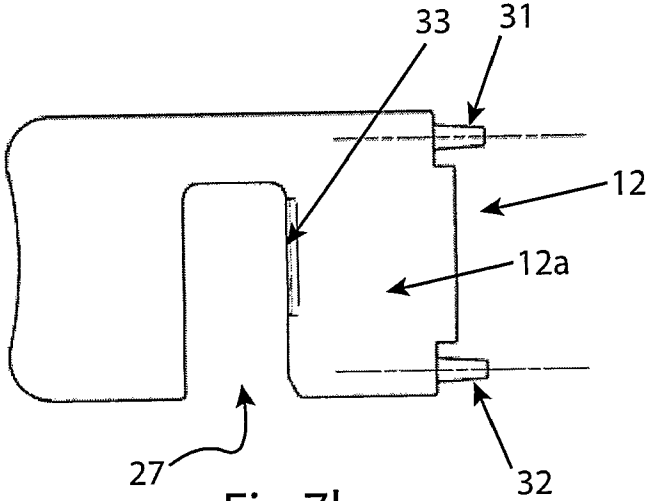
FIG. 7*b* is a front elevation of the second component of FIG. 7*a;*
Figure 7C:
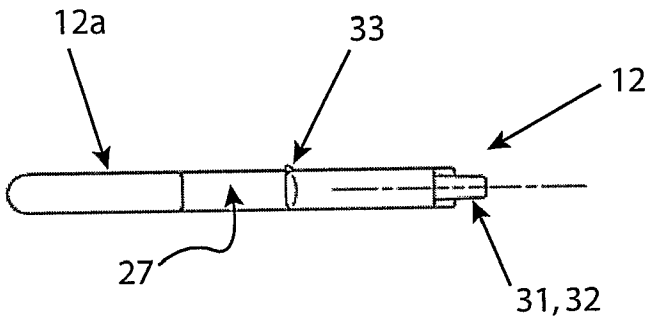
FIG. 7*c* is a side elevation of the second component of FIG. 7*a;*

As can be more clearly seen in FIGS. 6*a* to 6*c*, the housing is generally a hollow rectangular prism having spaced apart front and rear faces 11*a* and 11*b*, opposite side edge faces 11*c* and 11*d* and opposite end faces 11*e* and 11*f*. The hollow or cavity 16 extends from opening 17 at end 11*e* to terminate at blind end 11*f* and a passage 21 extends through the housing from the front face to the rear face with a side portion extending to edge 11*c* and at opening 22, the passage being defined by a generally square G-shaped face having opposed portions 24*a* and 24*b* forming the top and bottom of the G and an portion 24*c* forming the back of the G and a portion 24*d* forming the tag of the G adjacent opening 22. It will be seen that the passage is generally rectangular in front elevation although the housing adjacent the opening 22 forming the tag of the G as just described provides a side to the passage 21 and acts as a retention portion 23 such that the passage has a narrower portion leading to opening 22 as will be described in more detail later.

The shutter 12 generally corresponds to the shape of the housing and is adapted to be slidably mounted in the hollow 16 for a free sliding fit therein. Suitably, the shutter is generally also a thin rectangular prism having spaced apart front and rear faces 12*a* and 12*b*, opposite side faces 12*b* and 12*c* and opposite end faces 12*e* and 12*f*. A passage 27 extends from the front face to the rear face and sideways to side edge 12*c* to opening 28, the passage being defined by a U-shaped face having opposed faces 29*a* and 29*b* forming the sides of the U and an end face 29*c* forming the end of the U. The passage generally is the same shape as passage 21 in the housing except for the retention portion as will be described later. At inner end 12*d*, two spaced apart pegs 31 and 32 extend outwardly and are adapted to receive thereon the ends of coil springs 13 and 14 respectively to secure them to the shutter. A dog 33 extends outwardly from the front face 12*a* for securing the shutter in the housing as will be described later.

Figure 8:
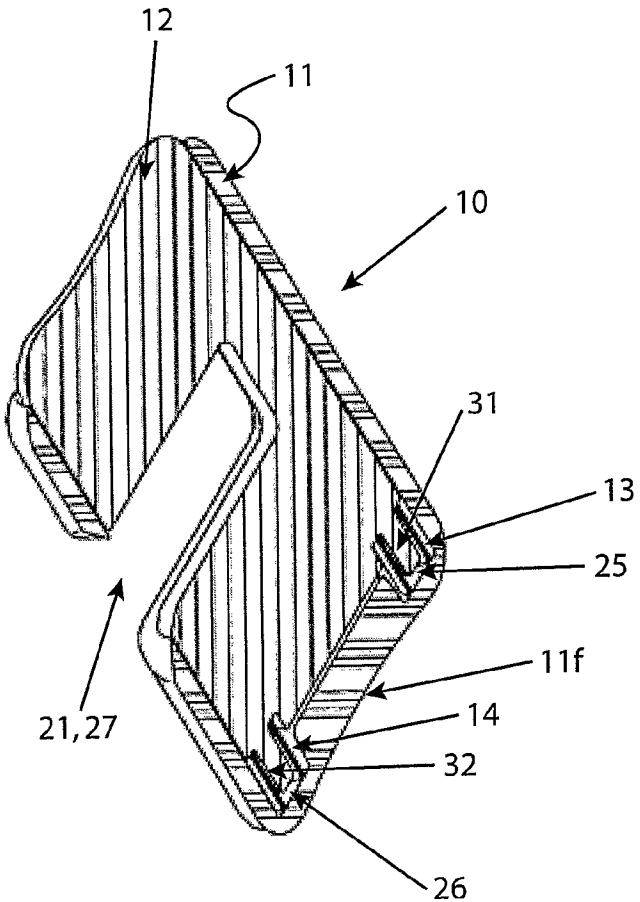
FIG. 8 is a sectional view of the clamp of FIG. 1 along line 8-8 in the open position.
Figure 9:
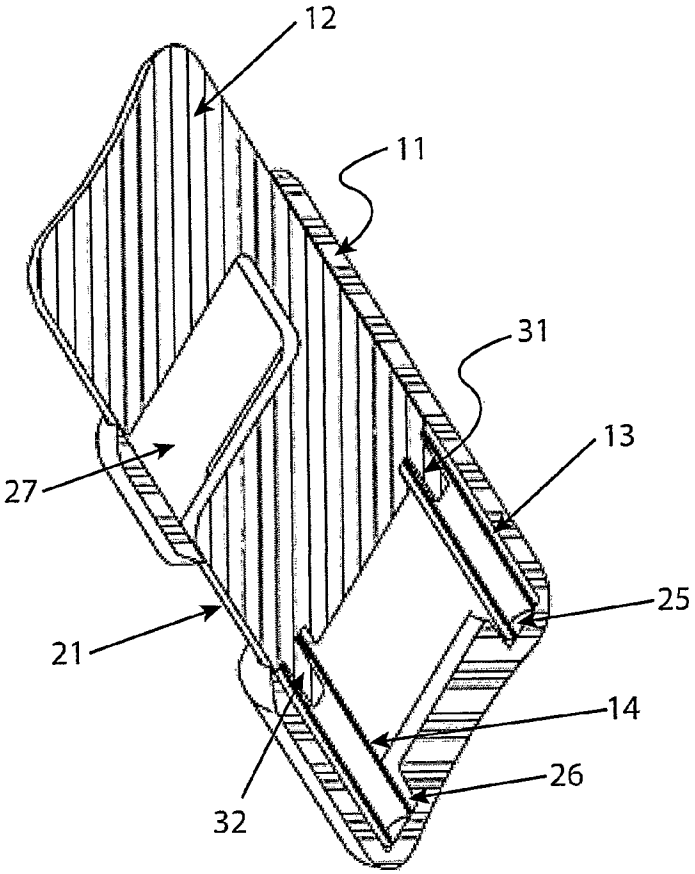
FIG. 9 is a sectional view of the clamp of FIG. 1 along line 8-8 in the closed position.
Figure 10:
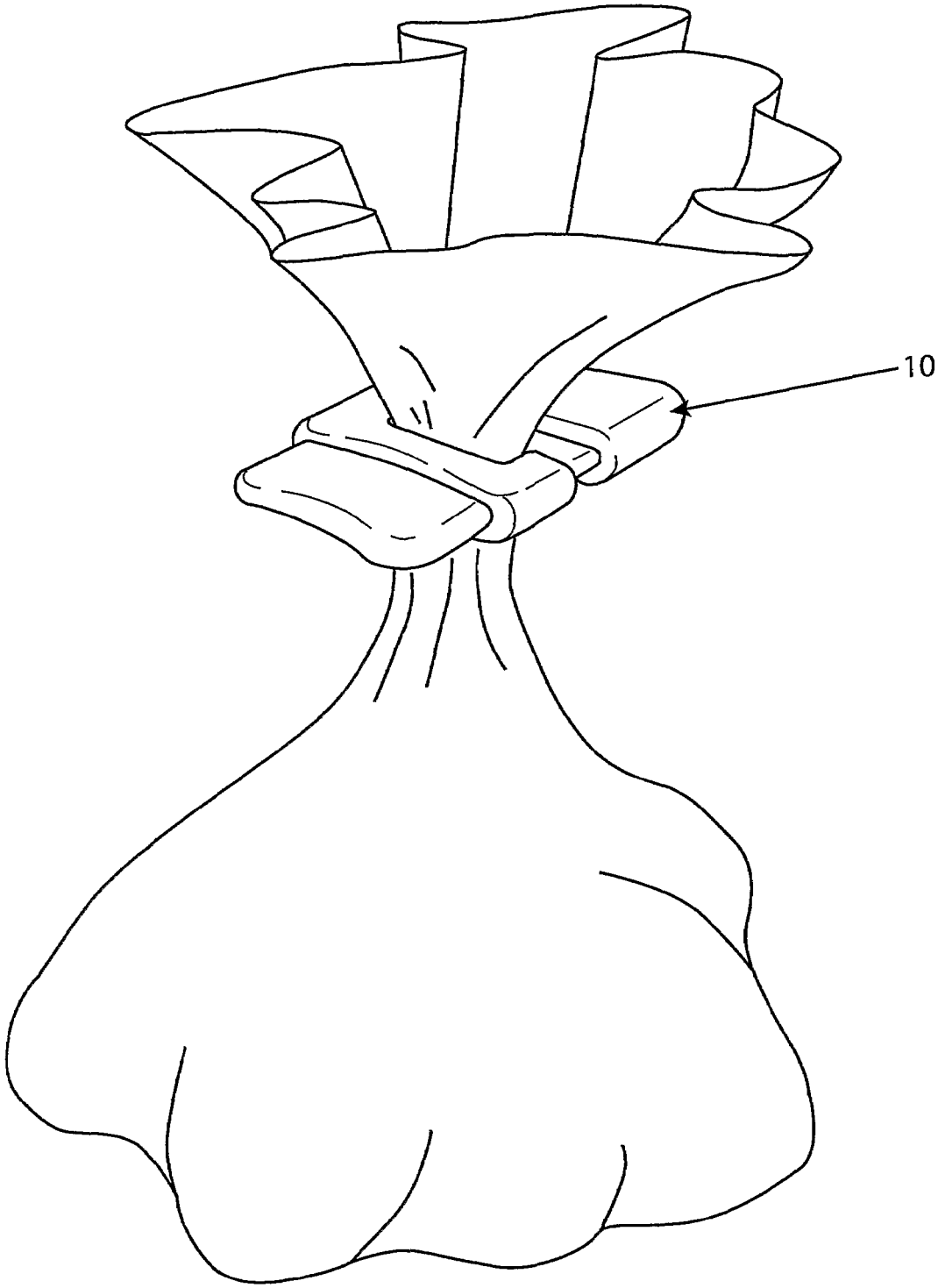
FIG. 10 is a pictorial representation of the clamp of FIG. 1 in use clamping the wall of a bag to close the bag.

As can be more clearly seen in FIGS. 8 and 9, the shutter is slidably mounted in the hollow of the housing with the springs 13 and 14 mounted at one end on the locating pegs 31 and 32 respectively and at their other ends being seated in the recesses 25 and 26 provided in the housing at blind end 11*f*, the springs being arranged to bias the shutter to the extended or closed position. The shutter is retained in the housing by the dog 33 which abuts face 24*b* of the housing, the housing and the dog being sufficiently flexible and suitably shaped to allow the dog to pass through the passage to fit the shutter into the housing but also to prevent the two parts being easily separated.

Suitably, the shutter can be forced fully into the hollow 16 by applying thumb pressure against end 12*e* of the shutter and finger pressure against end 11*d* of the housing to an open position wherein the opening 28 in the shutter aligns with opening 22 in the housing at which time the passage 27 in the shutter will be aligned with the passage 27 in the housing. In that relative position the sidewalls of a bag to be closed can be forced into the aligned passages through the aligned openings 22 and 28 following which thumb pressure on the shutter can be released. Release of the pressure will allow the springs to force the shutter outwards towards the closed position wherein the faces 29*b* of the shutter and 24*b* of the housing are urged towards each other and act in the manner of scissor type jaws on the bag walls thereby clamping them together to close the bag. To release the bag, the shutter is simply pressed in until the openings align and the clamp can be released from the bag for reuse if desired.

Figure 11:
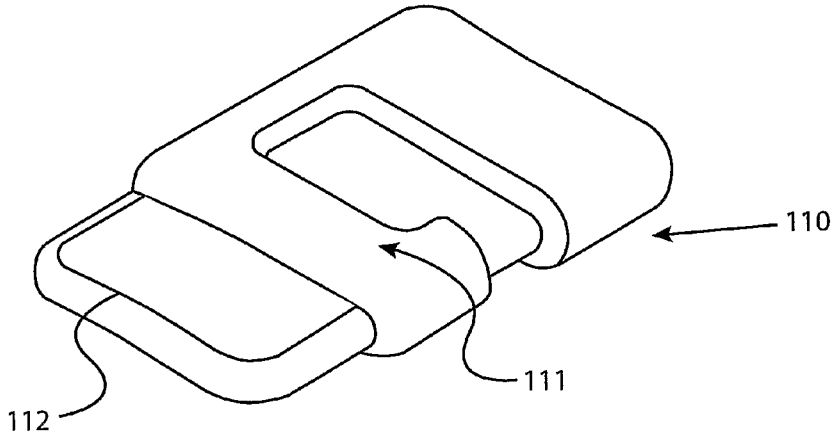
FIG. 11 is a pictorial representation of another clamp according to the invention in the closed position.
Figure 12:
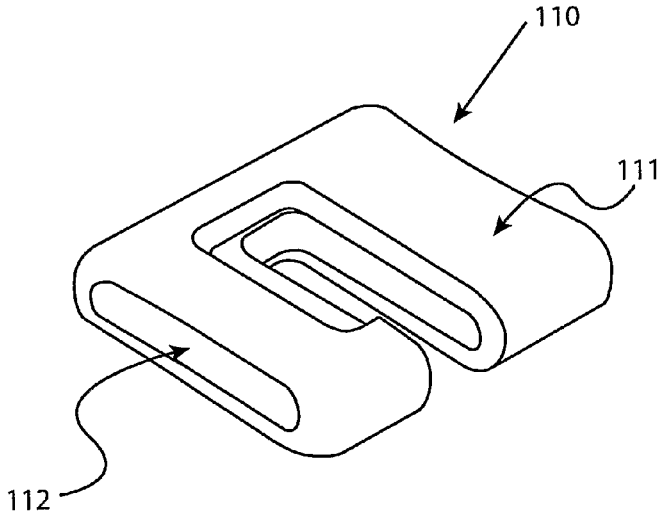
FIG. 12 is a pictorial representation of the clamp of FIG. 11 in the open position.
Figure 13A:
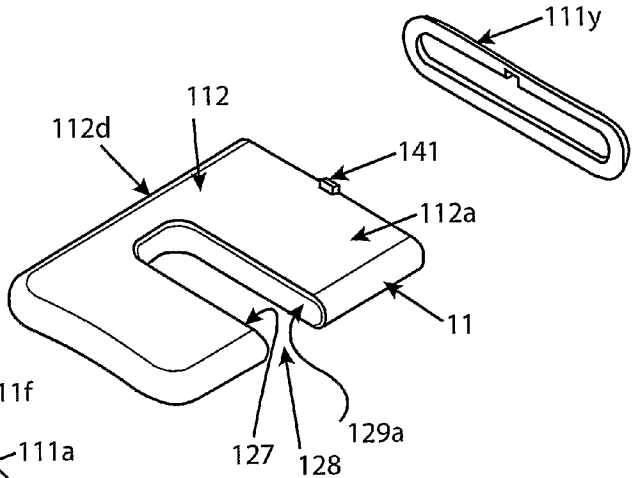
FIG. 13*a* is a pictorial representation of the clamp of FIG. 11 with its three main components in line for assembly.
Figure 13B:
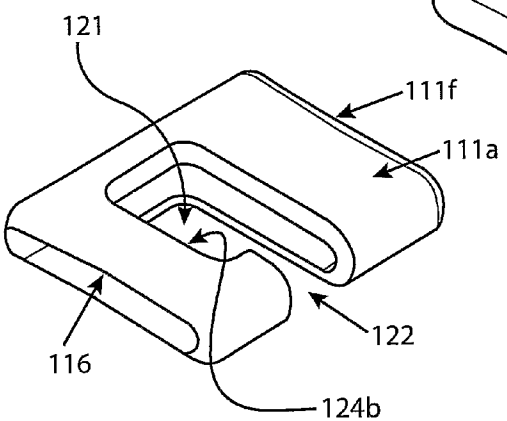
FIG. 13*b* is a pictorial representation of one of the components shown in FIG. 13*a* from the opposite end.
Figure 13B:
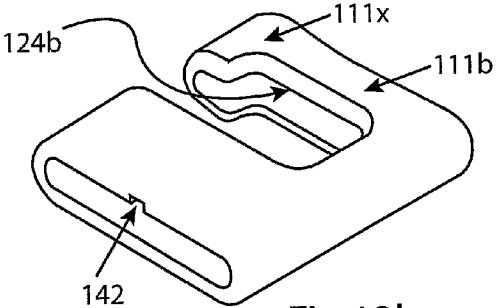
Figure 14A:
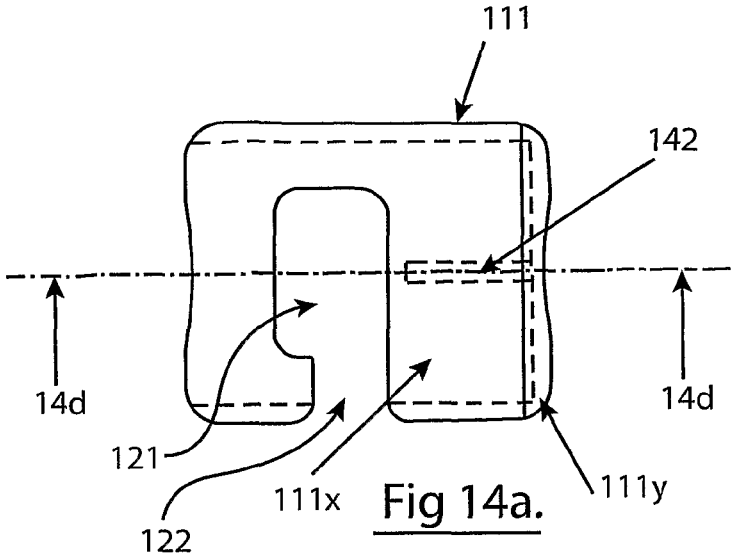
FIG. 14*a* is a front elevation of a first component of the clamp of FIG. 1.
Figure 14C:
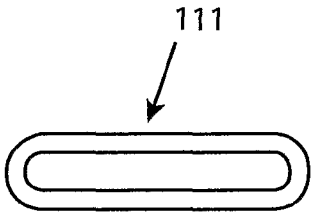
FIG. 14*c* is an end elevation of the component of FIG. 14*a;*
Figure 14B:
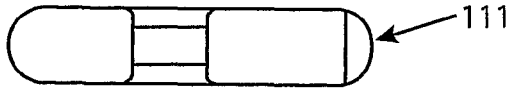
FIG. 14*b* is a side elevation of the component of FIG. 14*a;*
Figure 14D:
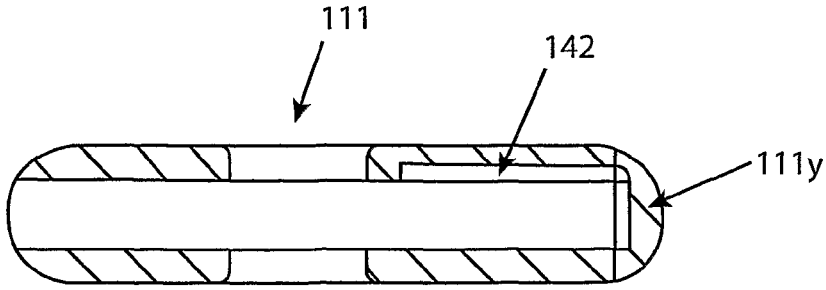
FIG. 14*d* is a sectional side elevation of the component of FIG. 14*a* along line 14*d*-14*d;*
Figure 15B:
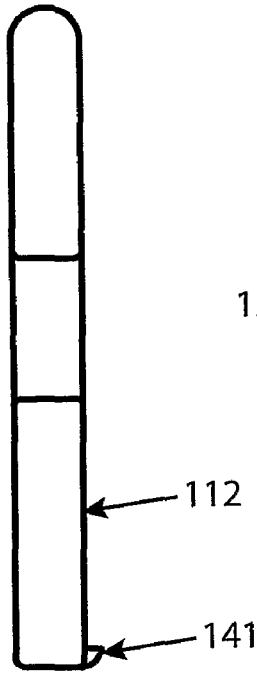
FIG. 15*b* is a side elevation of the second component of FIG. 15*a*.
Figure 15A:
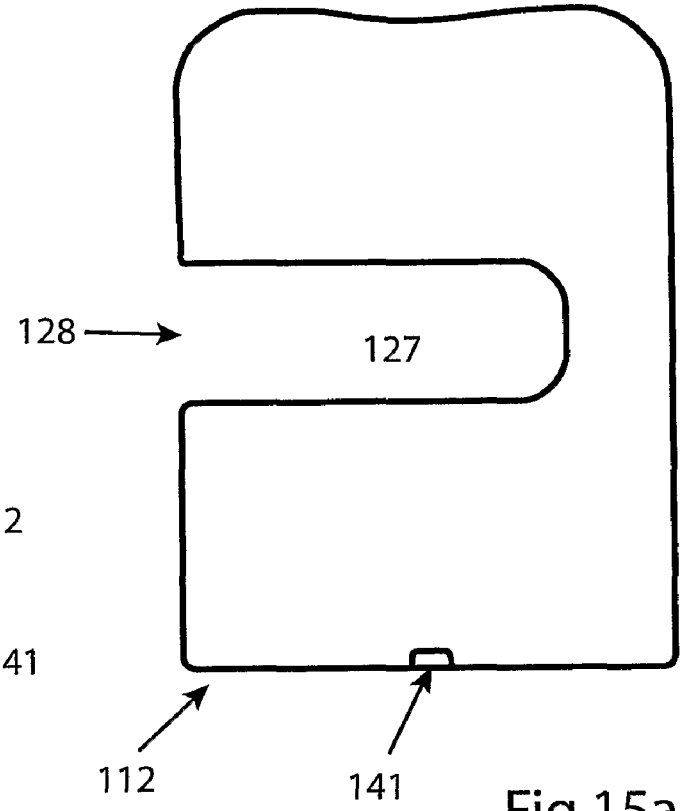
FIG. 15*a* is a front elevation of a second component of the clamp of FIG. 11.
Figure 15C:
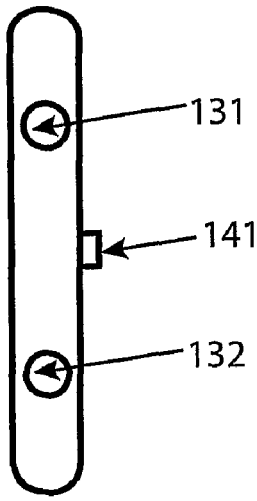
FIG. 15*c* is an end elevation of the second component of FIG. 15*a*.

The clamp 110 illustrated in FIG. 11 is similar to clamp 10 of FIG. 1 and accordingly corresponding reference numbers are used to reference corresponding components except prefaced by a "1". The main difference from Clamp 10 is that rather than the shutter 111 having a dog for retained it in the housing 112 as in the clamp of FIG. 1, it has a lug 141 which is engaged in a slot 142 in the housing. However, this arrangement requires that the housing have a sleeve part 111*x* and a separate end part 111*y* which can be secured to the sleeve part after the shutter has been fitted by a suitable adhesive, by sonic welding or the like. In such form of the invention, the slot extends into the front wall of the sleeve part from an inner face and terminates just short of the passage 121, engagement of the lug against the end of the slot preventing the shutter from separating from the housing under the bias of the springs. Additionally, instead of locating pegs 31 and 32 being provided for the springs, recesses 131 and 132 are provided.

While the forgoing description has been given by way of illustrative example of the invention, it will be understood that the invention may be embodied in many other forms and all such forms are deemed to fall within the board scope and ambit of the invention as defined in the appended claims.

The invention claimed is:

1. A clamp for closing a flexible bag, said clamp comprising:

a first member having a first passage therethrough providing a first jaw and a first opening to said first passage from one side;

a second member having a second passage therethrough providing a second jaw and a second opening to said second passage from one side; and a dog for stopping relative sliding movement of said first and second members from said closed position to said open position, said dog extending outwardly from said second member adjacent said second passage and is adapted to abut said first member and be moveably positionable in said first passage;

wherein said second member being engaged with said first member for relative sliding movement thereto between an open position in which said first and second jaws are spaced apart and said first and second openings are at least partially aligned and provide access to said first passage from one side and a closed position in which said first and second jaws cooperate to clamp a portion of a bag to be closed therebetween.

2. The clamp as set forth in claim 1, wherein said first member further comprising a retention portion located adjacent a side of said passage such that said passage has a narrower portion leading to said opening for retaining a bag portion clamped between said first and second jaws from being removed therefrom through said first and second openings while said first and second members are in the closed position.

3. The clamp as set forth in claim 1 further comprising at least one biasing means for biasing said first and second members to the closed position, wherein said biasing means being mountable at one end on at least one peg extending out from said second member and at its other end being seated in at least one recess provided in a blind end of said first member.

4. The clamp as set forth in claim 1, wherein said second member is a shutter and said first member has a recess which is adapted to slidably receive therein at least a portion of said shutter to provide said relative sliding movement between said first and second members.

5. The clamp as set forth in claim 4, wherein said recess is hollow and said first member forms a sleeve about the sliding portion of said second member to locate it securely therein for said relative sliding movement.

6. The clamp as set forth in claim 1, wherein said first and second members are generally planar.

7. The clamp as set forth in claim 6, wherein said first member has a front face and an opposed rear face, said first passage extends from said front face to said rear face and said first opening extends from a side edge of said first member between said front and rear faces to said first passage.

8. The clamp as set forth in claim 7 wherein said second member has a front face and an opposed rear face, said second passage extends from said front face to said rear face and said second opening extends from a side edge of said second member to said second passage.

9. The clamp as set forth in claim 8, wherein said second passage is a slot in said second member extending between opposed front and rear faces and which opens to a side edge of said second member.

10. The clamp as set forth in claim 9, wherein said dog extends outwardly from said front face of said second member and is adapted to abut said rear face of said first member.

11. A clamp comprising:

a first member having a first passage therethrough providing a first jaw and a first opening to said first passage from one side; and a second member having a second passage therethrough providing a second jaw and a second opening to said second passage from one side, said second member being engaged with said first member for relative sliding movement thereto between an open position in which said first and second jaws are spaced apart and said first and second openings are at least partially aligned and provide access to said first passage from one side and a closed position in which said first and second jaws cooperate to clamp a portion of a bag to be closed therebetween;

a biasing means for biasing said first and second members to the closed position; and a dog for stopping relative sliding movement of said first and second members from said closed position to said open position, said dog extending outwardly from said second member adjacent said second passage and is adapted to abut said first member and be moveably positionable in said first passage;

wherein said first member further comprising a retention portion located adjacent a side of said passage such that said passage has a narrower portion leading to said opening for retaining a bag portion clamped between said first and second jaws from being removed therefrom through said first and second openings while said first and second members are in the closed position.

12. The clamp as set forth in claim 11, wherein said first member has a front face and an opposed rear face, said first passage extends from said front face to said rear face and said first opening extends from a side edge of said first member between said front and rear faces to said first passage.

13. The clamp as set forth in claim 12, wherein said second member is a shutter and said first member has a recess which is adapted to slidably receive therein at least a portion of said shutter to provide said relative sliding movement between said first and second members.

14. The clamp as set forth in claim 13, wherein said recess is hollow and said first member forms a sleeve about the sliding portion of said second member to locate it securely therein for said relative sliding movement.

15. The clamp as set forth in claim 14, wherein said shutter further comprising at least one peg extending outwardly therefrom and being adapted to receive thereon the end of said biasing means respectively to secure said biasing means to said shutter.

16. The clamp as set forth in claim 15, wherein said shutter has a front face and an opposed rear face, said second passage extends from said front face to said rear face and said second opening extends from a side edge of said shutter to said second passage.

17. The clamp as set forth in claim 16, wherein said second passage is a slot in said second member extending between opposed front and rear faces and which opens to a side edge of said shutter.

18. The clamp as set forth in claim 17, wherein said dog extends outwardly from said front face of said shutter for securing said shutter in said first member.

19. The clamp as set forth in claim 18, wherein said biasing means is at least one compression coil spring, said coil spring's free end being seated in at least one recess provided in said first member.

20. A clamp comprising:

a first member having a first passage therethrough providing a first jaw and a first opening to said first passage from one side, a front face, at least two recesses provided in a blind end, and an opposed rear face, said first passage extends from said front face to said rear face and said first opening extends from a side edge of said first member between said front and rear faces to said first passage; and a shutter having a second passage therethrough providing a second jaw and a second opening to said second passage from one side, a front face and an opposed rear face, at least two pegs extending outwardly therefrom, and a dog, said dog extending outwardly from said front face of said shutter for securing said shutter in said first member, said dog being adapted to abut said first member and be moveably positionable in said first passage; and at least two coil springs for biasing said first member and said shutter to the closed position, each of said springs being adapted to receive at its end one of said pegs therein of said shutter respectively and at its other end being seated in one of said recesses respectively, thereby removably securing said biasing means to said shutter;

wherein said shutter being engaged with said first member for relative sliding movement thereto between an open position in which said first and second jaws are spaced apart and said first and second openings are at least partially aligned and provide access to said first passage from one side and a closed position in which said first and second jaws cooperate to clamp a portion of a bag to be closed therebetween;

wherein said first member further comprising a retention portion located adjacent a side of said passage such that said passage has a narrower portion leading to said opening for retaining a bag portion clamped between said first and second jaws from being removed therefrom through said first and second openings while said first and second members are in the closed position.

* * * * *